US006071040A

United States Patent [19]

Macku et al.

[11] Patent Number: 6,071,040

[45] Date of Patent: Jun. 6, 2000

[54] ADDITIVE INJECTION DEVICE FOR PAVING MACHINES

[75] Inventors: Charles G. Macku, Cedar Rapids, Iowa; John A. Trygg, Milford, Kans.; William Barth Burgett, Fredericktown, Ohio

[73] Assignee: Cedarapids Inc.,, Cedar Rapids, Ill.

[21] Appl. No.: 09/165,226

[22] Filed: Oct. 1, 1998

Related U.S. Application Data

[63] Continuation-in-part of application No. 08/918,089, Aug. 25, 1997, Pat. No. 6,007,272, which is a continuation of application No. 08/567,431, Dec. 5, 1995, abandoned.

[51] Int. Cl.[7] ..... E01C 19/18

[52] U.S. Cl. ..... 404/108; 404/111

[58] Field of Search ..... 404/92, 101, 108, 404/110, 111, 113

[56] References Cited

U.S. PATENT DOCUMENTS

| | | | |
|---|---|---|---|
| 2,067,236 | 1/1937 | Hepburn . | |
| 4,068,970 | 1/1978 | Rowe . | |
| 4,103,788 | 8/1978 | Sutton . | |
| 4,453,856 | 6/1984 | Chiostri et al. | 404/91 |
| 4,714,374 | 12/1987 | Mihara . | |
| 5,002,426 | 3/1991 | Brown et al. . | |
| 5,354,189 | 10/1994 | McKinnon . | |
| 5,529,247 | 6/1996 | Mleczewski . | |
| 5,553,969 | 9/1996 | Reed . | |
| 5,752,782 | 5/1998 | Hulicsko | 404/103 |
| 6,007,272 | 12/1999 | Macku et al. | 404/92 |

FOREIGN PATENT DOCUMENTS

| | | | |
|---|---|---|---|
| 2648168 | 5/1989 | France . | |
| 1584435 | 4/1966 | Germany . | |
| 1355620 | 6/1974 | United Kingdom . | |
| 2236342 | 4/1991 | United Kingdom | 404/108 |

OTHER PUBLICATIONS

Catalog Tim O'Neill/The Asphalt Contractor Midland Machinery Co. Inc. Nova–Paver™ "Here's How It Works" p. 88 (Jun. 1997).

*Primary Examiner*—James A. Lisehora
*Attorney, Agent, or Firm*—Marshall, O'Toole, Gerstein, Murray & Borun

[57] ABSTRACT

A device for applying a mat of aggregate material having an entrained liquid additive as the device is moved along a path. The device includes a hopper for receiving the aggregate material, a spreader for spreading the aggregate material generally transversely relative to the path, a compacting screed for compacting the aggregate material into the mat, and a mixing conveyor arranged to convey the aggregate material from the hopper to the spreader and to mix the aggregate material along the length of the conveyor. A conduit in flow communication with an additive supply source is mounted within and spans a portion of the hopper. The conduit thus communicates the liquid additive from the additive source to the aggregate material as the aggregate material is being mixed and conveyed.

33 Claims, 6 Drawing Sheets

ADDITIVE INJECTION DEVICE FOR PAVING MACHINES

RELATED APPLICATIONS

This application is a Continuation-in-Part of application Ser. No. 08/918,089, filed Aug. 25, 1997, now U.S. Pat. No. 6,007,272, which was a Continuation of application Ser. No. 08/567,431, filed Dec. 5, 1995, now abandoned.

FIELD OF THE INVENTION

The present invention relates generally to paving machines and the like equipped to apply a mat of aggregate on the ground as the machine is moved along a path. More specifically, the present invention relates to a paving machine having an additive injection system for applying a mat of crushed aggregate material having an entrained liquid additive contained therein.

BACKGROUND OF THE INVENTION

Devices for applying a mat of aggregate material, such as crushed stone, on a surface in preparation for subsequent paving are generally well known in the art. For example, an asphalt paving machine, when operated with crushed stone instead of hot mix asphalt material, may be used to apply a base layer of crushed aggregate prior to the placement of hot mix asphalt over the prepared base. A properly prepared and applied base layer will greatly improve the service life of the final layer of asphalt pavement.

In many instances, it is desirable to have an additive entrained substantially uniformly throughout the crushed aggregate material. The most common additive is water, although in some circumstances it may be desirable to add liquid emulsifying agents or dry additives such as lime. Typically, the additive is mixed into the aggregate material in a pug mill and then transferred to the paving machine for application on the ground.

Unfortunately, it is very difficult, if not impossible, to control the moisture content of the aggregate mix using conventional methods. Evaporation of the entrained water between the pug mill and the paver is affected by many variables, such as ambient temperature and humidity conditions, the distance from the pug mill to the paver, and the amount of handling of the aggregate mix. Accordingly, there exists a need for an improved device for injecting liquid or dry additives into a mix of aggregate material.

SUMMARY OF THE INVENTION

According to one aspect of the invention, a device for applying a mat of aggregate material having an entrained liquid additive as the device is moved along a path includes a hopper for receiving the aggregate material, a spreader for spreading the aggregate material generally transversely relative to the path, a compacting screed for compacting the aggregate material into the mat, a mixing conveyor arranged to convey the aggregate material from the hopper to the spreader and to mix the aggregate material along the length of the conveyor, and a conduit in flow communication with a liquid additive source, the conduit being disposed to span a portion of the hopper to communicate the liquid additive from the additive source to the aggregate material.

The mixing conveyor may include a pair of parallel spaced apart augers extending from the hopper to the spreader and generally parallel to the path of the device, and preferably the conduit extends generally parallel to, laterally between, and overlying the pair of spaced apart augers.

The conduit includes a pair of ends and includes a plurality of apertures spaced intermittently along its length between the ends to communicate or spray the liquid additive generally along the length of the hopper. A pump and a control valve are operatively connected to the liquid additive supply source and are provided to supply the liquid additive to the conduit and to control the flow rate of the liquid additive from the conduit into the aggregate material so that a desired concentration of the entrained additive can be achieved. The pump and the control valve further allow the additive concentration to be varied as field conditions and other requirements change. A second conduit, in flow communication with the additive source or with a second additive source, may be disposed adjacent to the spreader for injection of additional additive to the aggregate material in the vicinity of the spreader.

A pair of elongated members span the hopper and are disposed over the conveyor. The conduit is mounted between and supported by the elongated members, preferably by employing a plurality of transverse mounting brackets. The elongated members may be members having an inverted V-shaped cross-section, although other cross-sectional shapes may also be employed. The conduit is preferably mounted on a plurality of transverse straps extending between the pair of elongated members.

According to another aspect of the invention, a paving machine having a spreader and a compacting screed for forming a mat of aggregate material as the machine is moved along a path includes a device for injecting an additive into the aggregate material prior to formation of the mat. The device includes a hopper for receiving the aggregate material, a mixing conveyor arranged to convey the aggregate material from the hopper to the spreader and to mix the aggregate material as the aggregate material is being conveyed, and a conduit mounted adjacent the mixing conveyor. The conduit is in flow communication with an additive source, and the conduit is adapted to communicate additive from the additive source to the aggregate material.

According to yet another aspect of the invention, a machine for forming a mat of aggregate material as the machine is moved along a path includes a system for injecting a liquid additive into the aggregate material prior to formation of the mat. The system comprises a hopper for storing the aggregate material, a spreader disposed in front of a compacting screed, a mixing conveyor for conveying the aggregate material from the hopper to the spreader and for mixing the aggregate material substantially along the length of the conveyor, and means disposed in the hopper for injecting a liquid additive into the aggregate material.

According to a still further aspect of the invention, a paving machine having a liquid additive system includes a hopper for storing the aggregate material, a spreader for distributing the aggregate material generally transversely relative to a path of the machine, a compacting screed for compacting the aggregate material into a mat, a conveyor for conveying the aggregate material from the hopper to the spreader and for mixing the aggregate material substantially along the length of the conveyor, and means disposed in the hopper for injecting the liquid additive into the aggregate material and for mixing the liquid additive with the aggregate material.

The aforementioned features and advantages, in addition to other features and advantages, will become readily apparent to those skilled in the art upon a reading of the following detailed description.

DETAILED DESCRIPTION OF THE PREFERRED EMBODIMENT

Figure 1:
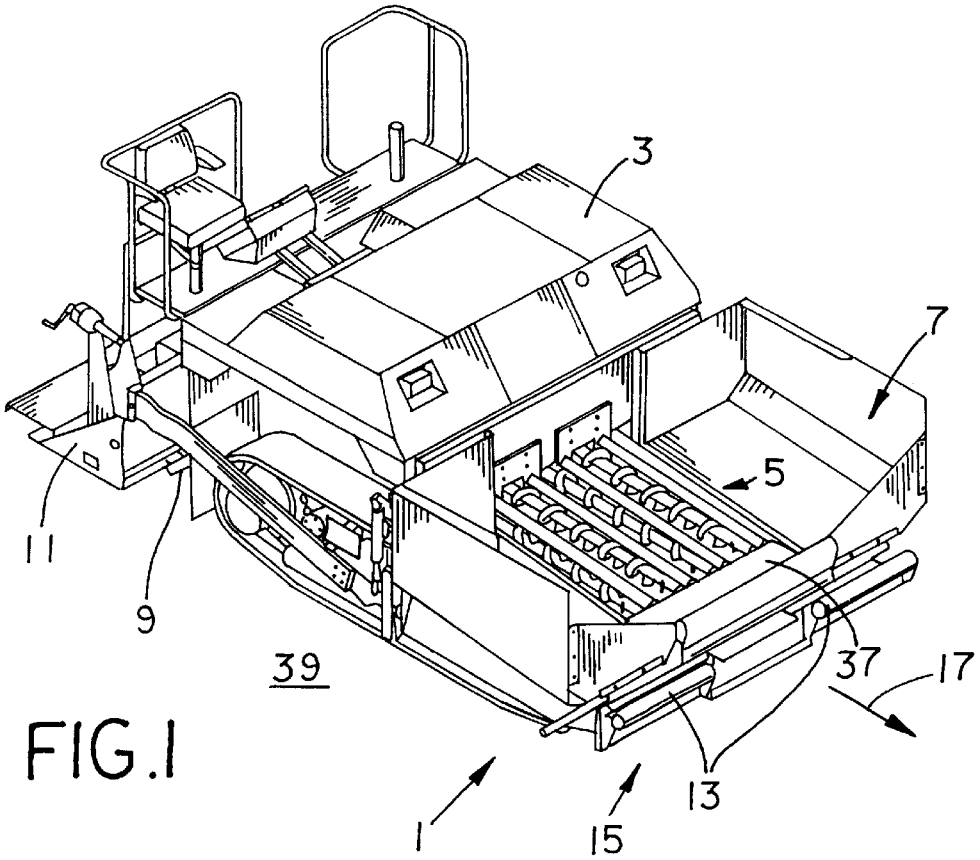
FIG. 1 is a perspective view of an asphalt paver having a remixing conveyor system.

The embodiments chosen for description herein are not intended to limit the scope of the invention to the precise form disclosed, but rather have been described in order to best explain the principles of the invention so that others skilled in the art may follow its teachings. As required, detailed embodiments of the present invention are disclosed herein. However, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The remixing conveyor system of the present invention provides a capability and a method for an asphalt paver to receive hot mix asphalt material having segregation characteristics and to remix that segregated hot mix asphalt material into a substantially uniform mixture before the hot mix asphalt material is placed by the asphalt paver into an asphalt paving mat on a subgrade. The additive injection system disclosed herein, when used in conjunction with the disclosed remixing conveyor system of the present invention, provides a capability and a method for the asphalt paver to receive aggregate material, such as hot mix asphalt material or crushed aggregate, sand, or any other paving substance, and inject an additive into the aggregate material such that the additive material is entrained in and dispersed throughout the aggregate material prior to formation of the aggregate material into a mat.

Referring now to the drawings, the reference numeral 1 generally refers to an apparatus comprising a remixing conveyor constructed in accordance with the teachings of the present invention. The apparatus 1 generally includes a paver 3 and desegregation or remixing means 5. The paver 3 includes a hopper 7, spreading means 9, and a screed 11. The hopper 7 is adapted to receive hot mix asphalt material, crushed aggregate, recycled aggregate, sand, gravel, or any other paving or base preparation compound (hereinafter referred to as "aggregate material) from a truck (not shown) that has been backed up against bumper rollers 13 situated at a front 15 of the paver 3. The spreading means 9 generally comprise a pair of opposing screw or spreading augers that distribute the aggregate material in front of the screed 11, generally transversely to the direction of travel 17 of the paver 3. The screed 11 levels and partially compacts the aggregate material distributed by the spreading means 9 for subsequent compaction, such as by an asphalt roller machine (not shown).

The remixing means 5 generally includes two feed auger assemblies 19 and 21. The feed auger assembly 19 includes a pair of feed augers 23 and 25 spaced substantially parallel to each other and parallel to the direction of travel 17 of the paver. Preferably, one of the feed augers 23 or 25 has a left-hand pitch whereas the other one of the feed augers 25 or 23 has a right-hand pitch. The feed augers 23 and 25 extend from the front of the hopper 7 to the vicinity of the spreading means 9. Driving means 27, such as pair of hydraulic motors 29 and 31, are adapted to counter-rotate the feed augers 23 and 25 about their respective longitudinal axes, as indicated by the arrows designated by the numerals 33 and 35 in FIG. 2.

It is to be understood that the feed augers 23 and 25 may be similarly pitched and both similarly rotated, either clockwise or counterclockwise as appropriate in order to convey the aggregate material from the hopper 7 to the vicinity of the spreading means 9. It is to be further understood that the motors 29 and 31 may be spaced at the front of the feed augers 23 and 25 under a removable protective cover 37, as shown in FIG. 1, or at the rear of the feed augers 23 and 25, in which case hydraulic hoses (not shown) to the motors 29 and 31 can generally be shortened considerably and the front of the hopper 7 can be spaced more closely-to the front 15 of the paver 3.

As the feed augers 23 and 25 rotate about their respective longitudinal axes, aggregate material is extracted from the hopper 7 by the feed augers 23 and 25 and is deposited in front of the spreading means 9 on the subgrade 39. For some applications, it may be-desirable that the peripheral diameter of portions of the feed augers 23 and 25 situated within the hopper 7 be tapered in order to more uniformly draw aggregate material both from the front of the hopper 7 and from the back of the hopper 7. For example, the feed augers 23 and 25 may each have a peripheral diameter of approximately six inches at the front of the hopper 7, a peripheral diameter of approximately ten inches at the back of the hopper 7, and a spacing between the longitudinal axes of the feed augers 23 and 25 of approximately thirteen inches. Preferably, the peripheral diameter of each of the feed augers 23 and 25 are substantially uniform from the back of the hopper 7 to the rearmost extremities of the feed augers 23 and 25 whereat the aggregate material is placed in front of the spreading means 9.

For other applications, relatively uniform extraction of aggregate material from both the front and rear of the hopper 7 may be of lesser concern, such as when the aggregate material received from trucks is dumped predominantly near the front of the hopper 7. In that event, the peripheral diameter of each of the feed augers 23 and 25 may be substantially uniform from the front of the hopper 7 to the rearmost extremities of the feed augers 23 and 25. For example, the feed augers 23 and 25 may have a uniform peripheral diameter of approximately ten inches and a pitch of approximately ten inches. It is to be understood that each of the feed augers 23 and 25 may be a single unit or may be constructed in sections-that are removably attached together.

Figure 2:
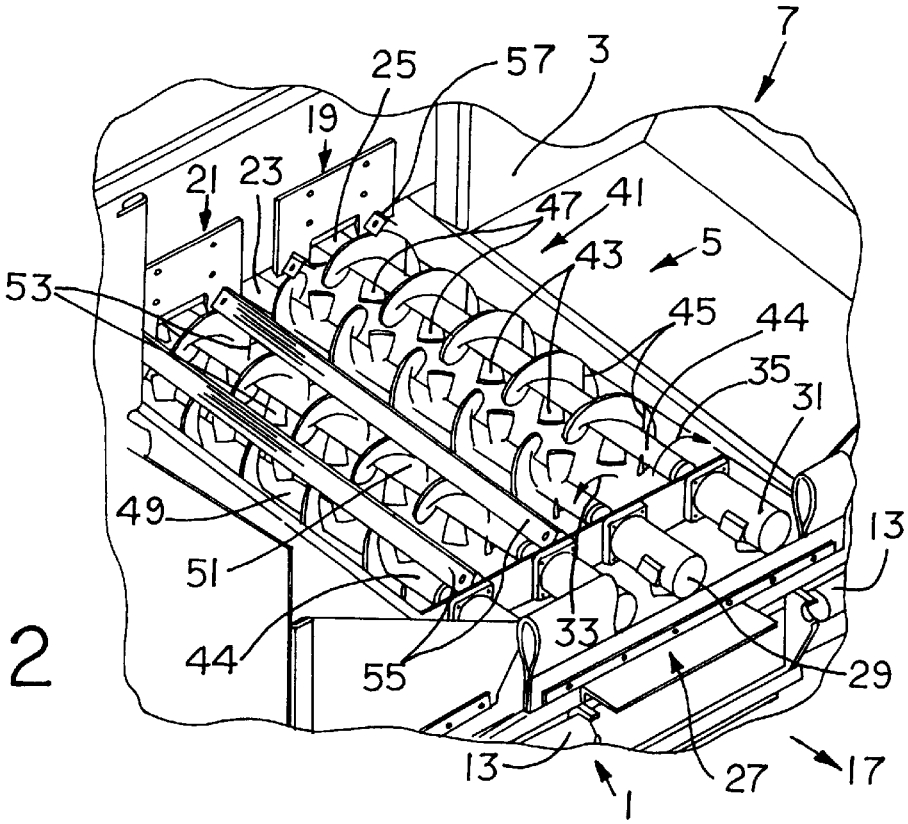
FIG. 2 is an enlarged fragmentary view in perspective of the asphalt paver shown in FIG. 1 with portions cut away to reveal components of the remixing conveyor system.

If desired and to further improve the efficiency of the remixing means 5, each of the feed augers 23 and 25 may have mixing enhancing means 41, such as at least one remixing blade 43 extending generally radially outwardly from a shaft 44 of each of the feed augers 23 and 25. Preferably, the enhancing means 41 comprises a series of the remixing blades 43 spaced intermediately between adjacent turns of the spirals of the feed augers 23 and 25, as shown in FIG. 2. The remixing blades 43 are oriented approximately 45° relative to their longitudinal axes, and generally opposite to the orientation of the pitch, of the respective feed auger 23 or 25. Preferably, the series of remixing blades 43 are arranged in two rows 45 and 47 spaced 180° from each other about the longitudinal axis of the respective feed auger 23 or 25 such that the respective remixing blades 43 are staggered along the longitudinal axis of the respective feed auger, 23 or 25. It is to be understood that one or more of the feed augers 23 and 25 may have more than two rows of the remixing blades 43.

Due to the arrangement of the remixing blades 43, as the feed augers 23 and 25 rotated about their respective longitudinal axes, the remixing blades 43 tend to displace the aggregate material forwardly toward the front of the hopper 7 as the spirals of the feed augers 23 and 25 displace the aggregate material rearwardly for discharge from the paver 37 with the result that the aggregate material in the vicinity of the remixing blades 43 is displaced intermittently side to side, or generally transversely relative to the direction of travel 17 of the paver 3. Thus, enhanced remixing of the aggregate material in the vicinity of the feed augers 23 and 25 occurs thereby preventing further segregation and further, substantially or entirely curing existing segregation of the aggregate material as it is being conveyed generally rearwardly by the feed augers 23 and 25. It is to be understood that the remixing blades 43 may be fixedly attached to the feed augers 23 and 25 or may be detachable whereby the remixing blades 43 can be selectively replaced or removed.

Similarly to the feed auger assembly 19, the feed auger assembly 21 includes a pair of parallelly spaced, oppositely rotated, and oppositely pitched feed augers 49 and 51, each with rows of remixing blades 53. The peripheral dimensions and orientation of, and spacing between, the feed augers 49 and 51 are substantially similar to those of the feed augers 23 and 25. It is to be understood that some applications may require only one of the feed auger assemblies 19 or 21; further, some applications may require more than two of the feed auger assemblies 23 and 25.

The spacing between the two feed auger assemblies 19 and 21 is arranged to efficiently convey substantial quantity of the aggregate material contained in the hopper to the spreading means 9. For example, the spacing between the innermost feed auger of the feed auger assembly 19 and the innermost feed auger 51 of the feed auger assembly 21 may be approximately twenty inches. In such an example, the feed auger assemblies 19 and 21 can remix and convey aggregate material at the rate of approximately three hundred tons per hour as the feed augers 23, 25, 49 and 51 are rotated at approximately one hundred forty revolutions per minute. It is to be understood that the feed augers 23, 25, 49 and 51 may be operated at any rotational speed up to their maximum design limits.

Generally, each of the feed augers 23, 25, 49 and 51 is centered below a respective elongate member 55, as shown in FIGS. 1 and 2. Each of the elongate members 55 are superimposed above a respective one of the feed augers 23, 25, 49 or 51 and is sufficiently spaced apart therefrom to avoid interfering with the rotation thereof. Preferably, the elongate members 55 are constructed of angle stock, such as 3"×3"×¼" material, or other suitable material. Both ends of the elongate members 55 are attached to the paver such as by brackets 57, as shown in FIG. 2.

The elongate members 55 provide some protection for the underlying feed augers 23, 25, 49 and 51 from the impact of aggregate material being dumped into the hopper 73 from trucks. In addition, the elongate members 55 help support the weight of aggregate material contained in the hopper 7 above the feed augers 23, 25, 49 and 41 to prevent operably overloading of the feed augers 23, 25, 49 and 51. Further, the spacing of the elongate members 55 encourage their respective feed augers 23, 25, 49 or 51 to draw aggregate material more laterally from the hopper 7 rather than from the aggregate material disposed more directly above the respective feed augers 23, 25, 49 and 51.

Figure 3:
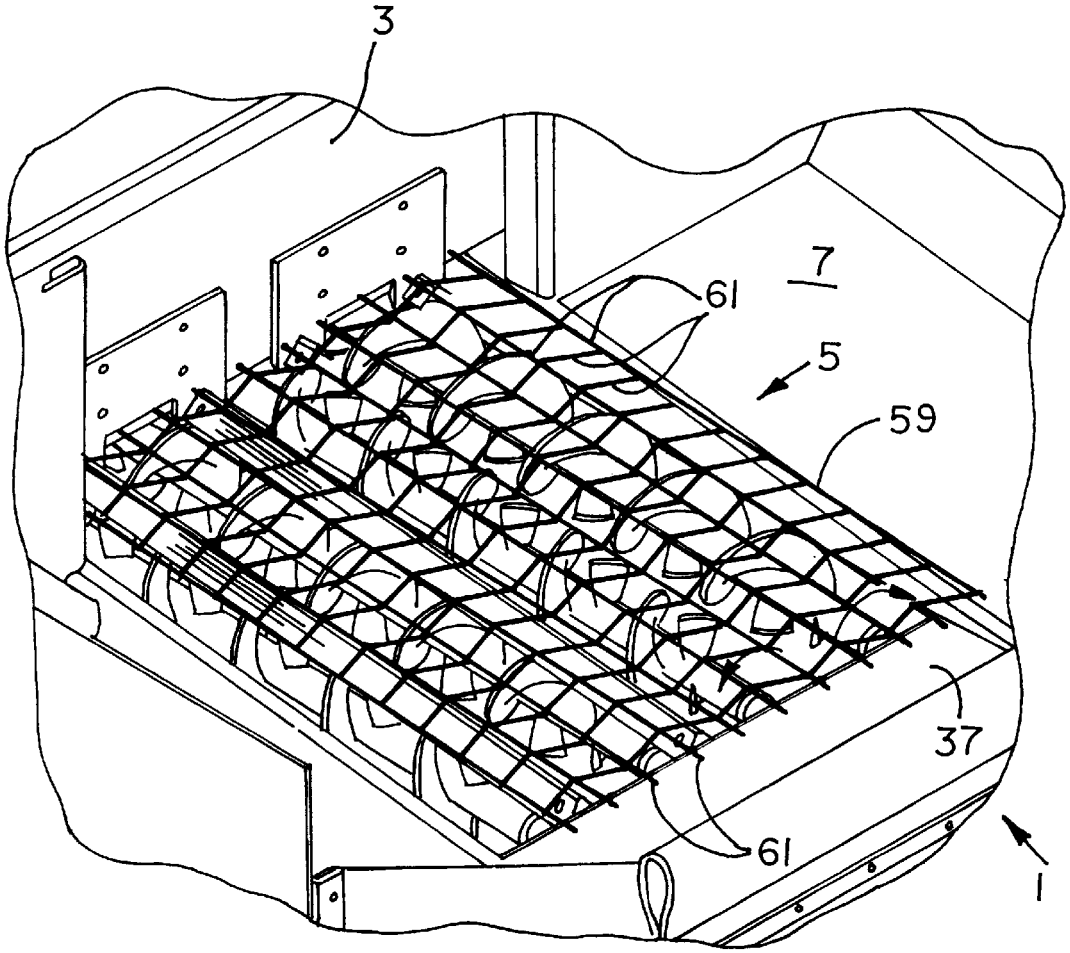
FIG. 3 is an enlarged fragmentary view in perspective, similar to that shown in FIG. 2, but including a feed screen.

To further prevent overloading of the feed augers 23, 25, 49 and 51 and to encourage the feed augers 23, 25, 49 and 51 to draw aggregate material more laterally from the hopper 7, the apparatus 1 may optionally include a feed screen 59, as shown in FIG. 3. The feed screen 59 should have sufficient structural strength to withstand the environment within the hopper 7 consistent with the forces and abusiveness involved during the placement of aggregate material in the hopper 7 and the removal of aggregate material from the hopper 7. For example, the feed screen 59 may be constructed of crisscrossing bars or rods 61 having a diameter of approximately ⅝ inch and the bars or rods 61 spaced on approximately 4½ inch centers. The feed screen 59 may be placed in abutting engagement with the elongate members 55 to provide additional support for the feed screen 59.

The remixing conveyor system of the present invention can be used in kit form to upgrade and convert existing asphalt paving machines and provide those asphalt paving machines with the ability to substantially or entirely eliminate segregation from hot mix asphalt material placed in those asphalt paving machines. The parallel slat conveyors of existing asphalt paving machines, each of which conveyor generally consists of two parallel chains with a multitude of transverse bars connected between them to convey hot mix asphalt material or other aggregate material from the receiving hopper to the rear of the asphalt paving machine, are removed and replaced with one of the feed auger assemblies 19 for each of the slat conveyors so removed. Included with each of the replacement feed auger assemblies 19 are the associated elongate members 55. In addition, each such upgrade conversion may include the optional feed screen 59. After the conversion, the upgraded paving machine can then remix and substantially or entirely eliminate segregation from the hot mix asphalt material or other aggregate material being placed by the asphalt paving machine.

The present invention includes a method for enabling an existing asphalt paving machine, having one or more slat conveyors and a spreading auger, to remove segregation from hot mix asphalt material placed in a hopper of the asphalt paving machine. The method includes the step of replacing each of the slat conveyors with a pair of parallel spaced feed augers, either similarly pitched and rotated or oppositely pitched and counter rotated as desired. To provide the additional functions as hereinbefore described, the method may also include the step of superimposing an elongate member over each of the feed augers of each pair of the feed augers. In addition, the method may also include the step of superimposing a feed screen over the elongate members as hereinbefore described. It is to be understood that the present invention may be used to remix materials other than hot mix asphalt material, that tend to exhibit segregation.

Referring now to FIGS. 4, 5, 6 and 7, an additive injection system constructed in accordance with the teachings of the present invention is generally referred to by the reference numeral 70. The additive injection system 70 is adapted for attachment to the above described paver 3 having a conveyor system 1 equipped with the remixing means 5. The additive injection system 70 is adapted to inject an additive 72 from a source 74 into the aggregate material contained within the hopper 7. The additive may consist of water, emulsifiers well known to those of skill in the art, or a dry additive such as lime or other suitable materials. The additive injection system 70 enables the additive 72 to be added to the aggregate material in the hopper 7, and then mixed into and dispersed within the aggregate material by the remixing means 5 prior to formation of the mat by the spreading means 9 and the screed 11.

The additive injection system 70 includes a conduit 76 mounted within and generally spanning the length of the hopper 7. Preferably, a conduit 76 is mounted adjacent each of the feed auger assemblies 19, 21. Although a pair of conduits are provided, for the sake of convenience only the structure and operation of a single conduit 76 will be discussed in detail. As shown in each of FIGS. 4, 5, 6 and 7, the conduit 76 is in flow communication with the additive source 74. The conduit 76 includes a pair of ends 78, 80, and also includes a plurality of injection nozzles 82 interspersed along the length of the conduit 76. As shown in FIG. 7, each conduit 76 is preferably mounted above and generally between the pair of feed augers 23, 25 or 49, 51. Additional conduits 76 may be provided. Also, as shown in FIG. 7, the injection nozzles 82 are preferably oriented in a generally downward direction to prevent clogging of the nozzles 82 by the aggregate material contained within the hopper 7. The conduit 76 is preferably oriented parallel to a longitudinal axis of the feed augers 23, 25 of the conveyor 1, although other orientations may be contemplated.

A pump 84 is provided for communicating the additive 72 from the additive source 74 through a plurality of supply lines 86. A control valve 88 is provided for controlling the rate and the volume of flow of the additive 72 through the supply lines 86 and hence through the nozzles 82. For example, the control valve 88 may be adjusted to supply the additive 72 at a rate proportionate to the speed of the paver 3 or at a speed proportionate to the rotational speed of the feed augers 23, 25, 49 and 51. Also, the control valve 88 may be operatively connected to the driving motors for the feed augers 23, 25, 49 and 51 in a conventional manner, so that the flow of additive commences and ceases along with the starting or stopping, respectively, of the driving motors. Alternatively, the control valve 88 may permit the flow to be adjusted independently of any other components of the paver 3.

Figure 4:
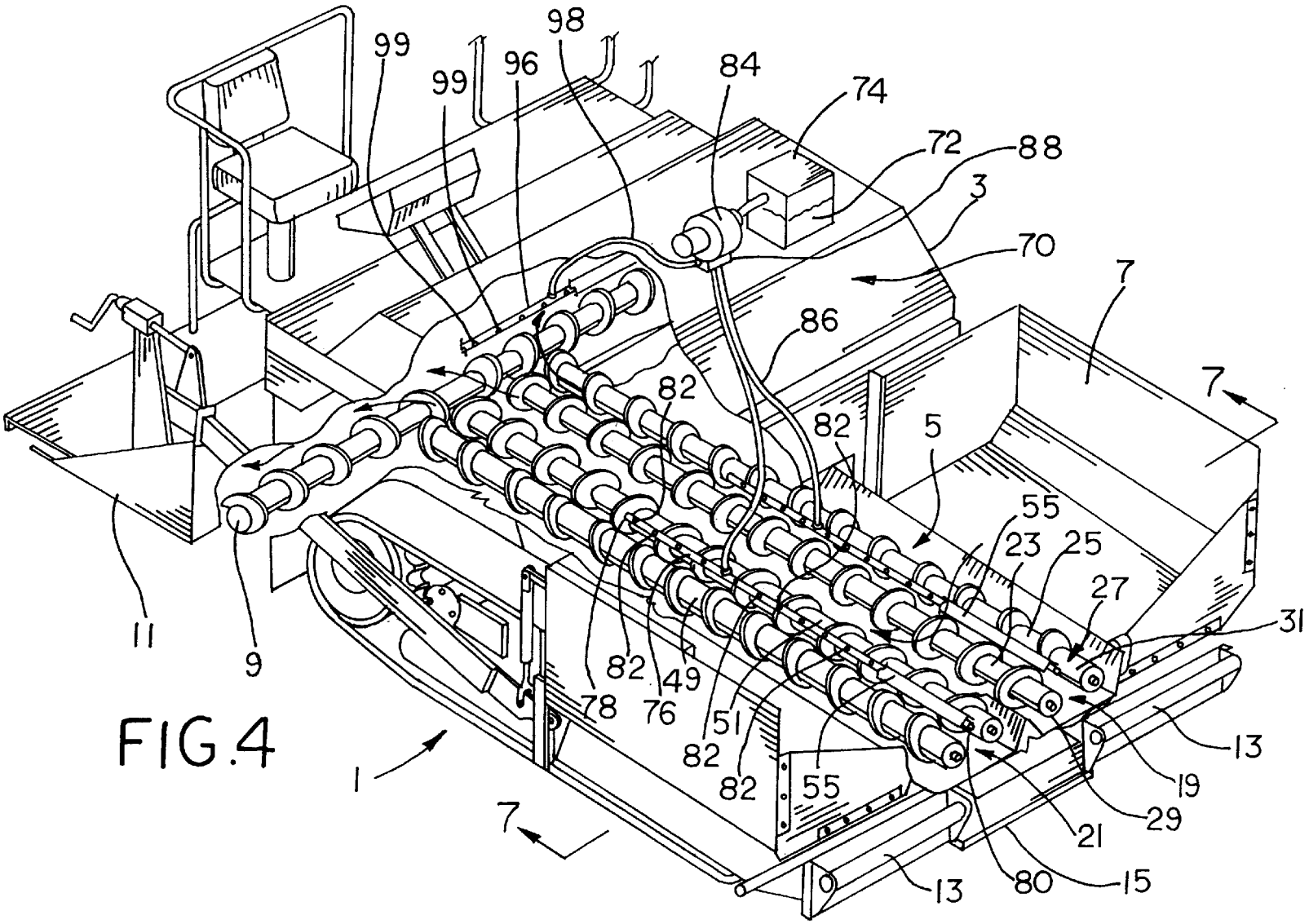
FIG. 4 is an enlarged view in perspective of the present asphalt paving machine similar to that shown in FIG. 1 but having the additive injection system of the present invention installed thereon.

As shown in FIGS. 1, 2 and 4, the elongated members 55 are mounted within and substantially span the hopper 7. As shown in FIG. 7, a plurality of mounting straps 90 are provided, which mounting straps 90 extend between adjacent elongate members 55. Each conduit 76 is mounted to the mounting straps 90 in a conventional manner, such as by commercially available mounting brackets, screws, bolts, or other attachment hardware (not shown). Preferably, the mounting straps 90 extend transversely relative to the feed augers 23, 25 or 49, 51 of the conveyor 1. The elongated members 55 have a generally inverted V-shaped cross-section, defined by a pair of downwardly depending flanges 92, 94.

Figure 5:
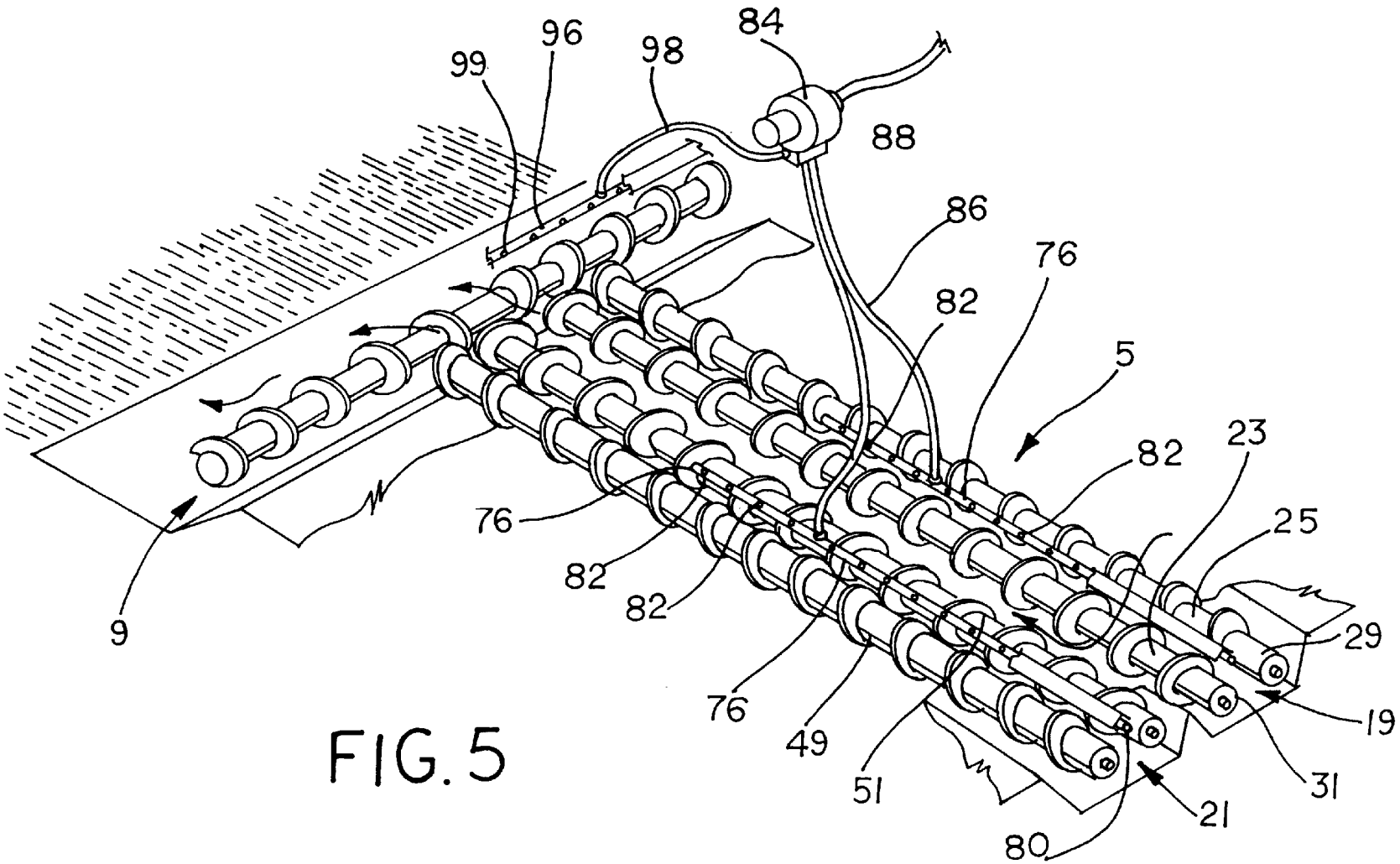
FIG. 5 is an enlarged fragmentary view in perspective showing the components of the additive injection system.
Figure 6:
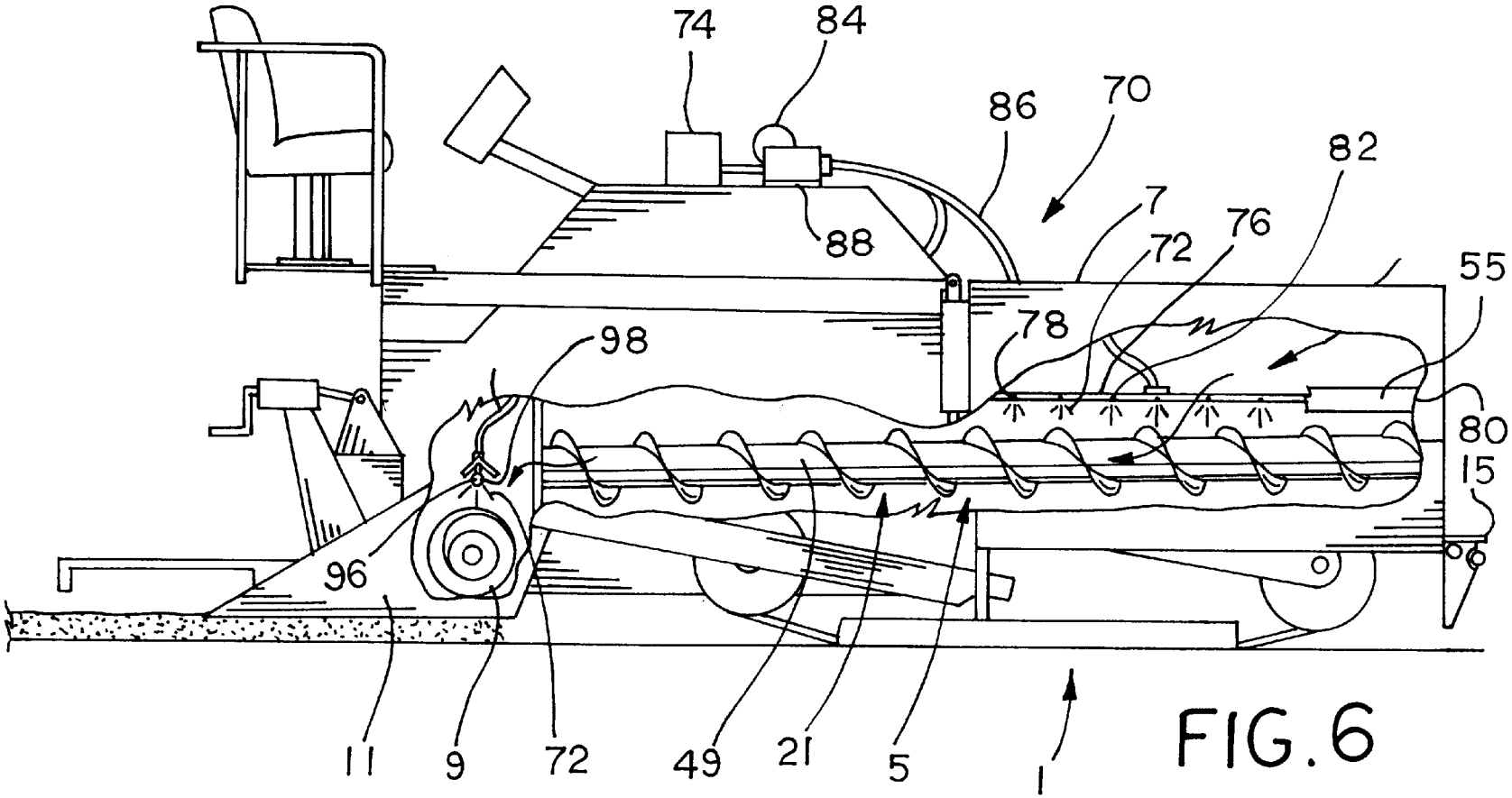
FIG. 6 is an elevational view of the asphalt paving machine shown in FIG. 4 and having portions of the machine cut away to reveal components of the additive injection system of the present invention.
Figure 7:
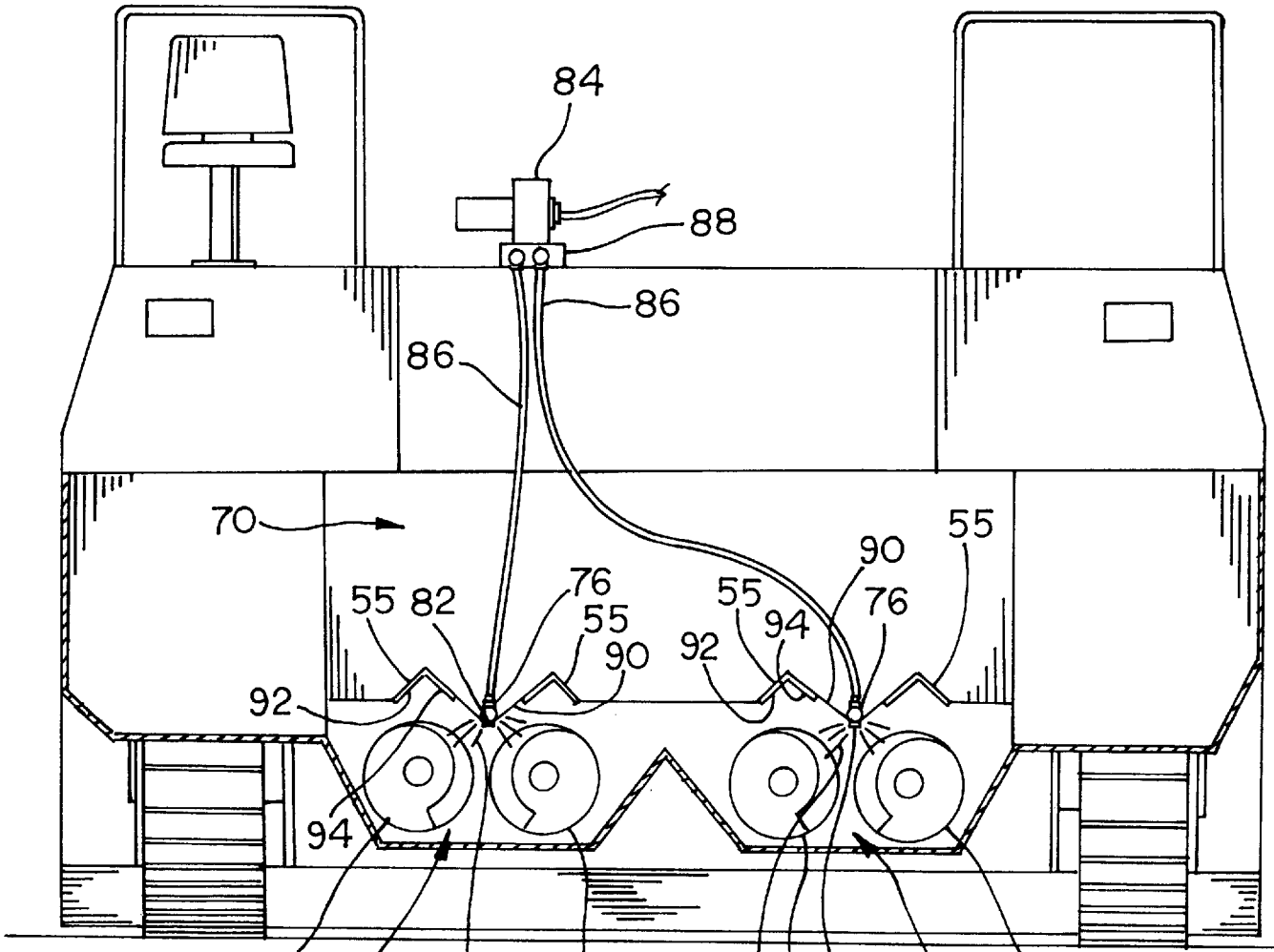
FIG. 7 is a cross-sectional view taken along lines 7—7 of FIG. 4.

As shown in each of FIGS. 4, 5 and 6, a second conduit 96 may also be provided. The second conduit is preferably disposed generally above and adjacent the spreading means 9, such that additional additive 72 may be sprayed into the aggregate material prior to formation of the mat. The second conduit includes a plurality of injection nozzles 99, which injection nozzles are preferably similar in construction and orientation to the injection nozzles 82 discussed above. The conduit 96 is also in flow communication with the additive source 74 by virtue of a second set of supply lines 98. The flow of additive 72 through the supply lines 98 to the second conduit 96 is also controlled by the control valve 88 in a manner similar to that described above with respect to controlling the flow to the conduit 76. Alternatively, a second additive source (not shown) having a second control valve (not shown) may be provided for certain applications. For example, it may be desired to add lime through the conduit 76 within the hopper 7, while adding water through the second conduit 96 in the vicinity of the spreading means 9. Many possible variations may be contemplated by those skilled in the art, such as adding water in one location and an emulsifier in the second location.

In operation of the additive injection system 70, the paver 3 is operated in the manner described above. Typically, the aggregate material is dumped from truck or transfer vehicle (not shown) directly into the hopper 7. As the paver 3 is moved along the desired path, the feed auger assemblies 19, 21 rotate the feed augers 23, 25 49 and 51 as described above, in order to mix the aggregate material as the material is being conveyed to the spreading means 9. As the augers 23, 25, 49 and 51 are being rotated by their respective drive motors, the additive 72 is sprayed through the nozzles 82 in the conduit 76, thus communicating the additive 72 into the aggregate material being mixed and conveyed. The mixing action of the feed auger assemblies 19 and 21 thoroughly mixes the additive into the aggregate material so that the additive 72 is dispersed or entrained substantially uniformly throughout the aggregate material.

In the event that the operator wishes to add additional additive material in the vicinity of the spreading means 9, the additional additive material is communicated through the supply lines 98 to the second conduit 96 for injection into the additive material through the nozzles 99.

It will be understood that the above description does not limit the invention to the above-given details. It is contemplated that various modifications and substitutions can be made without departing from the spirit and scope of the following claims.

What is claimed:

1. A device for applying a mat of aggregate material having an entrained additive as the device is moved along a path, comprising:

a hopper for receiving the aggregate material;

a spreader for spreading the aggregate material generally transversely relative to the path;

a compacting screed for compacting the aggregate material into the mat;

a mixing conveyor arranged to convey the aggregate material from the hopper to the spreader and to mix the aggregate material along the length of the conveyor, the conveyor including a pair of spaced apart axially rotatable augers disposed within the hopper and extending generally parallel to the path, the augers defining a remixing zone therebetween wherein the material is desegregated laterally relative to the path as the material is conveyed by the augers; and a conduit in flow communication with an additive source, the conduit having a plurality of nozzles and being disposed to span a portion of the hopper to communicate the additive from the additive source to the aggregate material.

2. The device of claim 1, wherein the conduit extends generally parallel to the augers.

3. The device of claim 1, wherein the augers extend generally parallel to the path, and further wherein the conduit is disposed generally parallel to the augers.

4. The device of claim 3, wherein the conduit is mounted generally above and laterally between the augers.

5. The device of claim 1, wherein the conduit includes a pair of ends and further includes a plurality of apertures spaced between the ends.

6. The device of claim 1, including a pump and a control valve operatively connected to the additive source.

7. The device of claim 1, including an aft conduit mounted generally adjacent the spreader, the aft conduit being in flow communication with the additive source.

8. On a paving machine having a spreader and a compacting screed for forming a mat of aggregate material as the machine is moved along a path, a device for injecting an additive into the aggregate material prior to formation of the mat, comprising:

a hopper for receiving the aggregate material;

a mixing conveyor including a pair of augers arranged to convey the aggregate material from the hopper to the spreader and to mix the aggregate material as the aggregate material is being conveyed; and a conduit mounted within the hopper and being disposed generally adjacent the mixing conveyor and extending along a length thereof, the conduit being in flow communication with an additive source, the conduit being adapted to communicate additive from the additive source to the aggregate material.

9. The device of claim 8, wherein the mixing conveyor includes a pair of parallel spaced apart augers extending between the hopper and the spreader.

10. The device of claim 9, wherein the augers extend generally parallel to the path, and further wherein the conduit is disposed generally parallel to the augers.

11. The device of claim 10, wherein the conduit is mounted generally above and laterally between the augers.

12. The device of claims 8, wherein the conduit extends generally parallel to and overlying the mixing conveyor.

13. The device of claim 8, wherein the conduit includes a pair of ends and further includes a plurality of injection apertures spaced between the ends, the injection apertures being adapted to communicate the additive along the hopper portion.

14. The device of claim 8, including a pump in flow communication with a supply line for communicating the additive from the additive source to the conduit, the pump being operatively connected to a controller for controlling the rate of additive flow into the aggregate material.

15. On a machine for forming a mat of aggregate material as the machine is moved along a path, a system for injecting a liquid additive into the aggregate material prior to formation of the mat, comprising:

a hopper for storing the aggregate material;

a spreader disposed in front of a compacting screed;

a mixing conveyor for conveying the aggregate material from the hopper to the spreader and for mixing the aggregate material substantially along the length of the conveyor; and injecting means for injecting the liquid additive into the aggregate material, the injecting means being adapted to inject the liquid additive substantially along a length of the mixing conveyor, the injecting means further including a plurality of injection nozzles disposed within the hopper and being located generally adjacent to the mixing conveyor.

16. The device of claim 15, including a pump having a control valve for communicating the additive to the conduit and for controlling a flow rate of the additive into the aggregate material.

17. The device of claim 15, including adjustment means for adjusting the flow rate of the additive into the aggregate material as the aggregate material is being conveyed.

18. The device of claim 15, wherein the mixing conveyor includes a pair of parallel spaced apart augers extending between the hopper and the spreader.

19. The device of claim 18, wherein the augers extend generally parallel to the path, and further wherein the injecting means is disposed generally parallel to and overlying the augers.

20. The device of claim 18, wherein the injecting means spans a portion of the hopper and wherein said plurality of injection nozzles inject the additive into the hopper at a plurality of predetermined locations.

21. The device of claim 15, wherein the injecting means is adapted to inject the additive material along a length of the hopper.

22. The device of claim 15, including aft injecting means for injecting additive generally adjacent the spreader.

23. The device of claim 15, including a second conduit mounted adjacent to the spreader and having a plurality of injection nozzles, the second conduit being in flow communication with an additive source.

24. The device of claim 15, including a pair of elongated members spanning the hopper and being disposed over the conveyor, and wherein the injecting means is supported by the elongated members.

25. A paving machine having a system for injecting a liquid additive into an aggregate material, comprising:

a hopper for storing the aggregate material;

a spreader for distributing the aggregate material generally transversely relative to a path of the machine;

a compacting screed for compacting the aggregate material into a mat;

a mixing conveyor adapted to convey the aggregate material from the hopper to the spreader and to mix the aggregate material as the aggregate material is being conveyed; and means disposed in the hopper generally adjacent to the mixing conveyor and extending substantially along a length of the mixing conveyor for injecting the liquid additive into the aggregate material, whereby the liquid additive may be mixed with the aggregate material by the mixing conveyor.

26. A device for applying a mat of aggregate material having an entrained additive as the device is moved along a path, comprising:

a hopper for receiving the aggregate material;

a spreader for spreading the aggregate material generally transversely relative to the path;

a compacting screed for compacting the aggregate material into the mat;

a mixing conveyor arranged to convey the aggregate material from the hopper to the spreader and to mix the aggregate material along the length of the conveyor;

a conduit in flow communication with an additive source, the conduit having a plurality of nozzles and being disposed to span a portion of the hopper to communicate the additive from the additive source to the aggregate material;

a pair of elongated members spanning the hopper and being disposed over the conveyor, the conduit being mounted between the elongated members by a plurality of transverse mounting brackets.

27. The device of claim 26, wherein the elongated members include an inverted V-shaped cross-section.

28. On a paving machine having a spreader and a compacting screed for forming a mat of aggregate material as the machine is moved along a path, a device for injecting an additive into the aggregate material prior to formation of the mat, comprising:

a hopper for receiving the aggregate material;

a mixing conveyor arranged to convey the aggregate material from the hopper to the spreader and to mix the aggregate material as the aggregate material is being conveyed;

a pair of elongated members spanning the hopper and being disposed over the conveyor;

a conduit mounted between the elongated members by a plurality of mounting brackets and being disposed adjacent the mixing conveyor, the conduit being in flow communication with an additive source, the conduit being adapted to communicate additive from the additive source to the aggregate material.

29. The device of claim 28, wherein the elongated members include an inverted V-shaped cross-section.

30. The device of claim 28, wherein the mounting brackets include a transverse strap extending between the elongated members.

31. On a machine for forming a mat of aggregate material as the machine is moved along a path, a system for injecting a liquid additive into the aggregate material prior to formation of the mat, comprising:

a hopper for storing the aggregate material;

a spreader disposed in front of a compacting screed;

a mixing conveyor for conveying the aggregate material from the hopper to the spreader and for mixing the aggregate material substantially along the length of the conveyor;

a pair of elongated members spanning the hopper and being disposed over the conveyor; and injecting means for injecting the liquid additive into the aggregate material, the injecting means being supported by the elongated members.

32. The device of claim 31, wherein the elongated members include an inverted V-shaped cross-section.

33. The device of claim 31, wherein the injection means is supported by a transverse mounting strap extending between the elongated members.

* * * * *